US006109387A

United States Patent [19]

Boretti

[11] Patent Number: 6,109,387

[45] Date of Patent: Aug. 29, 2000

[54] SILENCER FOR GAS DISCHARGE DEVICES

[76] Inventor: Napoleon P. Boretti, 13834 Del Webb Blvd., Sun City, Ariz. 85351

[21] Appl. No.: 09/356,863

[22] Filed: Jul. 19, 1999

[51] Int. Cl.[7] ..... B21J 3/02; F01N 1/24

[52] U.S. Cl. ..... 181/230; 181/222; 181/217; 181/243; 181/256; 181/258; 181/248; 181/252

[58] Field of Search ..... 181/230, 212, 181/222, 217, 213, 243, 256, 226, 241, 258, 248, 252; 173/DIG. 2

[56] References Cited

U.S. PATENT DOCUMENTS

| | | | |
|---|---|---|---|
| 3,949,828 | 4/1976 | Frochaux | 181/36 A |
| 4,184,564 | 1/1980 | Trainor | 181/230 |
| 4,211,303 | 7/1980 | Matthews et al. | 181/248 |
| 4,316,523 | 2/1982 | Boretti | 181/226 |
| 4,449,609 | 5/1984 | Stoll | 181/230 |
| 4,530,417 | 7/1985 | Daniel | 181/223 |

*Primary Examiner*—Bentsu Ro
*Assistant Examiner*—Edgardo San Martin
*Attorney, Agent, or Firm*—Warren F.B. Lindsley; Frank J. McGue

[57] ABSTRACT

Silencer for gas discharge device employing easily replaceable cartridge utilizing juxtapositioned layers of wire mesh and porous resilient material which dissipate the energy stored in an exhaust system and deflect under pressure of the exhaust gases to provide a self cleaning function and a cylindrical liner mounted within the cartridge comprising the same or larger wire mesh and wire diameter size than used in the cartridge for capturing the large particles of the exhaust gases before they pass through the layers of wire mesh forming the cartridge.

10 Claims, 4 Drawing Sheets

SILENCER FOR GAS DISCHARGE DEVICES

BACKGROUND OF THE INVENTION

This invention relates to devices for muffling and silencing of noises in fluid pressure exhausts and more particularly to silencers of mufflers for the exhaust systems of compressed air operated power cylinders, tools or the like.

1. Field of the Invention

This invention is particularly directed to improved and novel muffling devices for silencing exhaust noises by directing exhaust gases under pressure through new and improved energy absorbing cartridges to atmosphere with axial and radial flow occurring in different embodiments of the muffling devices.

2. Description of the Prior Art

Heretofore, mufflers have been used for the dissipation of exhaust noises wherein the exhaust stream of gases is diverted by fins or ribs of a spider means within the mufflers. Other mufflers have dissipated exhaust noises of an exhaust system in a silencing chamber by the utilization of porous walls through which the exhaust fluid is diffused.

Applicant's U.S. Pat. No. 4,316,523 is believed to be the closest prior art known.

Other patents of interest comprise the following references cited in U.S. Pat. No. 4,316,523.

U.S. Pat. No. 763,626 discloses a muffler for moving a gas to atmosphere from an engine which employs a spring biased valve movably guided on a shaft.

U.S. Pat. No. 797,681 discloses a muffler device employing a relief means for providing an alternate route for the exhaust gas in response to an increase in the pressure of the gas within the muffler.

U.S. Pat. No. 1,479,714 discloses a muffler for exhaust gases from an internal combustion engine employing an alternate route when the gas pressure reaches a given value. The alternate route is controlled by a weighted door hingedly secured to the end of the alternate route.

U.S. Pat. No. 1,512,210 discloses a muffler for an internal combustion engine employing an alternate route which opens up in response to increased pressure within the muffler which alternate route is controlled by a lever arm and spring mechanism.

U.S. Pat. No. 1,666,005 discloses a muffler employing a spring loaded valve for controlling the escape of gases under pressure.

U.S. Pat. No. 3,208,551 discloses an air silencer for pneumatic devices which includes a cylindrically shaped shell having circumferential slots therein to provide air outlets in communication with the interior of the shell and an air restricting cartridge made of a screen material for muffling the sound of the moving air.

U.S. Pat. No. 3,219,144 discloses a muffler for an internal combustion engine which includes spring biased means for controlling an adjustable exhaust port in response to the pressure of the exhaust gas.

U.S. Pat. No. 3,380,553 discloses an exhaust muffler wherein the noise level of the fluid under pressure moving therethrough is reduced by reducing the velocity of the fluid and causing the fluid to expand thereby expending energy.

U.S. Pat. No. 3,612,214 discloses a safety relief for an air silencer for a pneumatic device which includes means for redirecting the flow of air if the pressure within the silencer reaches a predetermined level.

U.S. Pat. No. 3,672,465 discloses an air exhaust silencer employing baffle members made of a porous material wherein the air is broken up and exhausted therethrough to atmosphere.

Applicant has disclosed herein an energy absorbing cartridge employing a novel arrangement of juxtapositioned layers of wire cloth and soft resilient energy absorbing materials to reduce exhaust air noises and to induce a breathing action which provides a self-cleaning action to prevent loading and premature failure of the cartridge assembly. Two new components, a liner and an insert, are incorporated in this new design to provide a low air pressure drop barrier to trap foreign particles before they reach the resilient parts of the cartridge.

SUMMARY OF THE INVENTION

In accordance with the invention claimed, an air silencer or sound absorbing device is provided which employs an easily replaceable and adjustable novel air restricting device which effectively reduces high noise levels of escaping air from a pneumatic valve, motor and other air operated tools to a safe decibel level.

It is, therefore, one object of this invention to provide an improved fluid muffler or silencer for effectively reducing high and low frequency noises of an escaping fluid under pressure.

Another object of this invention is to provide an improved compact, small, simple and economical muffler or silencing device that can be easily assembled and disassembled for cleaning purposes without removing the device from the exhaust system of the associated equipment.

A further object of this invention is to provide a novel and improved muffler for silencing exhaust fluid under pressure discharged from a machine which employs an easily changeable baffle arrangement formed in disc or cylindrical form.

A still further object of this invention is to provide means for trapping foreign large particles entrained in the air to extend the life of the silencer.

Another feature of this invention is to provide a two component cartridge assembly using a replaceable insert for air cleaning purposes.

The present invention resides in certain constructions, combinations and arrangements of the parts and further objects and advantages will be apparent to those skilled in the art to which the invention relates from the following description of the preferred embodiment described with reference to the accompanying drawing forming a part of this specification.

BRIEF DESCRIPTION OF THE DRAWINGS

The present invention may be readily described by reference to the accompanying drawings, in which.

DESCRIPTION OF THE PREFERRED EMBODIMENTS

Figure 1:
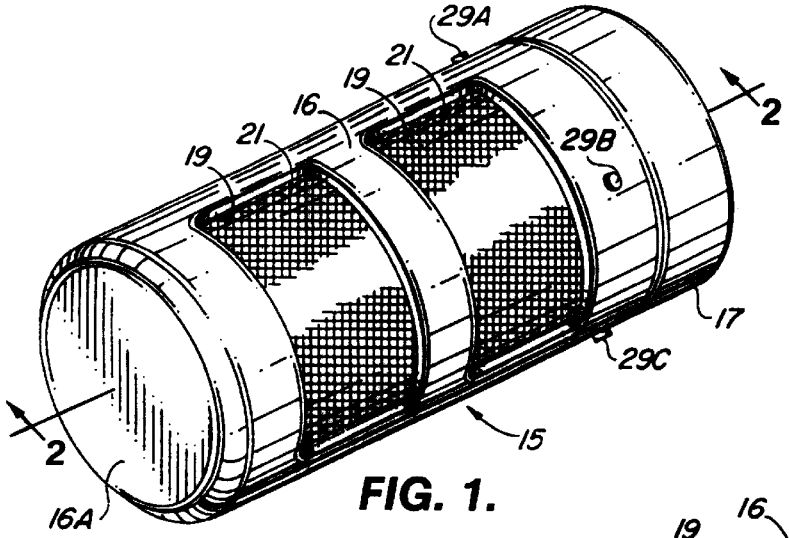
FIG. 1 is a perspective view of a muffler or silencer embodying the invention.

Referring more particularly to the drawings by characters of reference, FIG. 1 discloses a silencer or muffler 15 comprising a cylindrical housing 16 connectable at one end to a coupling 17 forming the entrance port to the muffler. The coupling 17, which is thicker and heavier in construction than the walls of housing 16 to suppress vibration, may be internally threaded, as shown at 18 in FIG. 2, for connection to the exhaust of a fluid driven machine tool (not shown). The housing 16 is provided with one or more windows or exhaust ports 19 through which fluid such as air under pressure entering into the interior of the housing through coupling 17 is exhausted to atmosphere.

Figure 5:
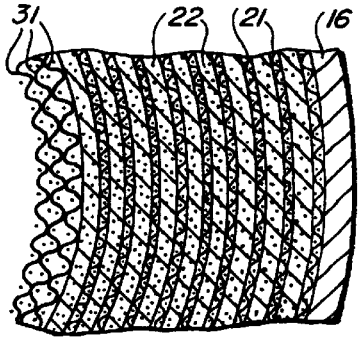
FIG. 5 is a cross sectional view of the outlined area in FIG. 3.

Within housing 16 is detachably mounted a cylindrical cartridge 20 forming a baffle for silencing the noise of air under pressure being dispersed therethrough. As best seen in FIG. 5, this comprises a plurality of coaxially arranged cylindrical elements forming alternate layers of wire cloth material 21 and a suitable grade of compressible foam or textile material 22. These coaxially arranged cylindrical elements form a hollow cylindrical passageway 23 extending axially therethrough.

As shown in FIG. 1, as well as FIGS. 2 and 3, hereinafter described, the mufflers are provided with heavy walled couplers for connection to the associated equipment which help attenuate noise amplification caused by the air discharging function of the associated equipment. The inner chamber in the cartridge provides a choking action of the explosive force of the discharged air from the associated equipment. The entrance way into the hollow interior of the cartridge not only controls the rate of discharge into its hollow interior but also protects the cartridge from air erosion.

Figure 2A:
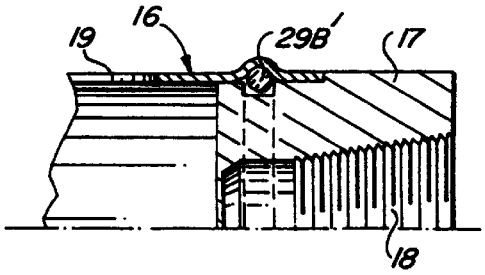
FIG. 2A is a modification of the cartridge attaching means shown in FIG. 1.
Figure 2:
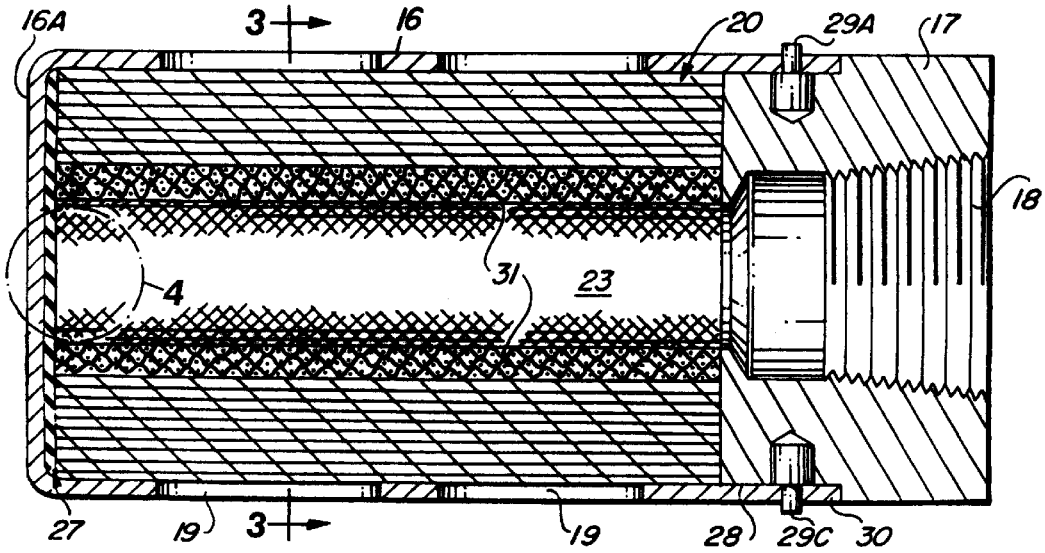
FIG. 2 is a cross sectional view of FIG. 1 taken along the line 2—2.
Figure 3:
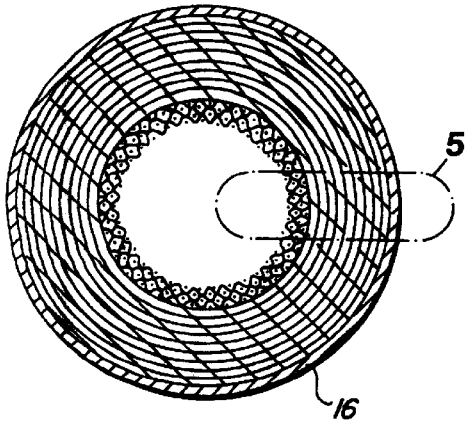
FIG. 3 is a cross sectional view of FIG. 2 taken along the line 3—3.
Figure 4:
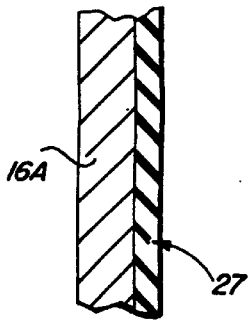
FIG. 4 is an enlargement of the circled area marked 4 in FIG. 2.

As shown in FIG. 2, a resilient gasket 27 is positioned within the left end 16A of housing 16 to dampen noise amplification. This configuration forms a snug arrangement of cartridge 20 within housing 16 with the right end 30 of the housing flanged to fit partially around the outwardly extending surface 28 on coupling 17. Thus, by merely pulling out pins 29A–29C, cartridge 20 can be removed, cleaned and/or replaced without disconnecting the muffler from the associated machine tool or provide a spring wire to assemble the shell to the base.

Where used, the rubber or resilient gasket absorbs the initial high velocity wave front of the discharged air which would otherwise impinge on the inner end of housing 16 and also compensate for dimensional tolerances in the assembly of the parts. In this manner, the component parts of the mufflers can be made to wider tolerances than normal to cut down on the manufacturing costs without affecting the silencer's performance. The rubber gasket is also used to seal the gap between the shell or housing 16 and the cartridge 20 to prevent air from escaping axially past the gasket.

In operation, air under pressure discharged from the machine tool enters the hollow interior of coupling 17, called the inner chamber, and passes therethrough into the cylindrical passageway 23 formed by cartridge 20 and called the outer chamber. The air in the outer chamber which is dispersed along the length of passageway 23 flows radially outwardly through the cylindrical elements forming cartridge 20 to atmosphere through the windows or ports 19 formed in housing 16. Housing 16 forms a shell protector for the energy absorbing cartridge and acts as a retainer for the cartridge as well as provides by its window locations directional flow of the air discharged to atmosphere.

Cartridge 20 is held against gasket 27, as shown in FIG. 2, by coupling 17 fitted into the open end of housing 16 and held in bearing arrangement against gasket 27 by pins 29A, 29B and 29C or other suitable device spacedly arranged around the periphery of housing 16 to extend through the walls of the housing into suitable apertures in coupling 17. These pins may be grooved, tapered or necked down at their outer ends so as to interlock under tension with the walls of housing 16 to be firmly held in place. To readily dislodge the pins to remove the cartridge from the housing, the housing and coupling are moved toward each other which is made possible by compressing gasket 27 thereby releasing the tension of the housing on the pins so that they can be easily removed in a known manner. This gasket may be of a low durometer.

As shown in FIG. 2A, pins 29A, 29B and 29C are replaced by a wire ring 29B', positioned in a suitable groove in the outer periphery of coupling 17.

As noted from FIG. 2 of the drawings, coupling 17 is provided with internal threads 18 for engaging with the threads of an associated air discharging device (not shown). This structure may have external threads, if so desired, which can be interchangeably used in silencer assemblies. As best seen in FIG. 5, cartridge 20 illustrates a multi layer cartridge assembly comprising a cylinder of suitable sound absorbent material 22 covered internally and externally along its length by a suitable wire mesh or wire cloth like material 21, i.e. multiple layers of wire and sound absorbent material. Housing 16 is provided with suitable windows 19 for directing air under pressure received by the muffler configuration to atmosphere. This muffler configuration functions in the same general manner as described above for the muffler shown in U.S. Pat. No. 4,316,523 embodied herein by reference. This muffler configuration differs, inter alia, from that shown in U.S. Pat. No. 4,316,523 by utilizing a liner 31 comprising multiple layers of variable or similar wire diameter and mesh for filtering out in depth large particles in the exhaust gases before reaching and penetrating the resilient layers of wire mesh and flexible porous material 22 of the cartridge assembly. It diffuses and reduces air turbulence and absorbs part of the energy stored in the air stream.

As mentioned above, cartridge 20 comprises a plurality of contiguous layers of wire mesh and resilient porous material arranged sequentially to form a hollow cylindrical configuration of a plurality of layers of wire mesh and porous material.

Figure 9:
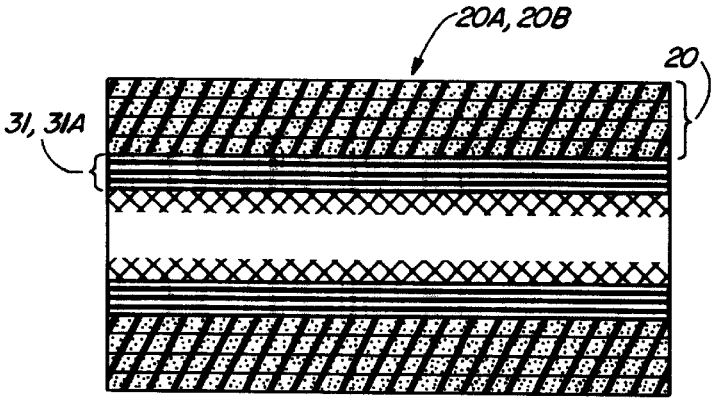
FIG. 9 is a cross sectional view of the cartridge, liner and insert as shown in FIGS. 7 and 8.

As best seen in FIG. 9, liner 31 is provided for co-axial arrangement with cylinder 20 and comprises multiple layers of suitable wire size and mesh or other material forming a low resistance barrier to the air flow and arranged to trap large quantities of stringy shaped foreign particles entrained by the air under pressure flowing through the cartridge assembly. It should be recognized that liner 31 is intended to form an integral part of cartridge 20. Liner 31 and the flexible porous layers of cartridge 20 constitute the cartridge assembly 20A. As best seen in FIG. 9–12, when liner 31 is formed of a separate replaceable part of the cartridge assembly it will be referred to as insert 31A which may comprise the same wire mesh and wire diameter as cartridge 20 or be larger or smaller than the wire and mesh size of cartridges 20. Liner 31 and insert 31A can also be made of fibrous, porous, woven, perforated, serrated, embossed, corrugated, or other suitable materials.

The wire mesh forming the multiple layers of insert 31A for cartridge 20 provides a low resistance barrier to the air flow to trap large foreign particles entrained in the exhaust gas while the smaller particles in the exhaust gases passing into and through the remaining layers of wire mesh and compressible foam like material forming cartridge 20 and through windows 19 of housing 16 to atmosphere.

The cartridge is the main energy absorbing element in the muffler. It is made up of alternate layers of wire cloth material and a suitable grade of compressible foam or textile material. In FIGS. 1–3 and 5 the air passes radially through the cartridge wall thus crossing alternate layers of wire cloth and resilient foam (or alternate material) and discharges into the atmosphere through large windows or ports in the shell or housing 16. In the configuration shown in FIG. 3, the wire cloth and resilient foam materials are rolled or wound concentrically forming alternate layers of wire cloth and resilient material to absorb different noise frequencies. The inner section of the cartridge assembly, heretofore called the liner 31 best seen in FIG. 5, is made up of several layers of wire cloth and wire mesh to help prevent loading of the outer section of the cartridge with foreign large particles, to absorb part of the initial shock of the air discharge, to defuse the air flow pattern, to reduce air turbulence, to reduce air pressure drop and to improve the air flow through the cartridge.

Each layer of cartridge 20 is made up of a resilient compressible material sandwiched between two wire cloth cylinders. Air flowing through the sandwich is subjected to alternate contraction, expansion and contraction again due to the varying restriction through the materials making up the sandwich.

The contraction and expansion process through each sandwich absorbs a portion of the energy stored in the air as it flows through the cartridge. This process is repeated several times, the number of times depending on the density of the resilient material, its thickness and the wire cloth mesh used. Thus, it is possible to obtain any degree of quietness for a range of air discharge rates. The resiliency of the material adds another very important factor to the quietness of the silencer. The velocity of the air being discharged from the device drops exponentially at the instant air discharge starts. Air flows initially at a high velocity, the rate of which is regulated by coupling 17 before it enters the outer or diffusion chamber. This velocity head is changed to a large extend into a pressure head which compresses the resilient layers thus causing a momentary high resistance to the air flow. As the air flow drops abruptly, it is accompanied by a decompression of the resilient layers thus maintaining a higher average rate of discharge through the cartridge as compared to an incompressible medium which has a constant flow characteristic.

The wire cloth layers, which help the contraction and expansion effect, also help contain the resilient layers to limit their magnitude of motion to prevent excessive flexing and consequent breakdown of the compressible material.

The resilient layers are precompressed, the extent of precompression depending on the noise muffling desired. The compressible nature of the material and the resulting motion within the layers of the cartridge due to air pressure changes help dislodge foreign particles thus preventing premature loading of the resilient layers. This breathing action performs a dual function; first, it provides an automatic means for varying the resistance to the air flow; secondly, it helps prevent premature loading of the cartridge. Each layer can be designed to provide an equal or varying value of energy absorption. The number of layers and the materials in each layer in a cartridge is determined by the noise criteria established by governmental agencies, and upon the standard established by industry for maximum allowable discharge time for a given load.

A well designed silencer meets both of these requirements. The disclosed silencer or muffler not only meets but exceeds all such requirements. It is compact for applications where space is limited and the outer layers of the assembly are mechanically strong to prevent damage.

The shell or housing 16 is made of tubular material and is designed to withstand impacts from external sources and extreme vibrations inherent to some equipment it may be mounted on. It is provided with large apertures or windows through which the air is exhausted to the atmosphere. The shell is not used to regulate air flow to the atmosphere as in the case in some existing silencers. These apertures can also be located on one side of the shell to obtain directional discharge required by some installations to prevent personnel exposure to air blasts, to avoid contamination of operating equipment and to promote good plant housekeeping by directing the air discharge, which may contain lubricating oils, away from building internal structures.

The cartridge assembly may comprise inner and outer sections with both sections employing the same mesh and wire diameter. The inner and outer sections of the assembly may comprise the same screen mesh. Further, the inner section may have a variable wire mesh or variable wire diameter. The invention is intended to include variable wire mesh and wire diameter in any combination and still fall within the scope of this invention.

As disclosed herein, cartridge 20 is provided with a cylindrical wire configuration in combination with insert 31A or liner 31 that constitutes the inside surface of the cartridge assembly. When either an insert 31A or liner 31 is used in the cartridge assembly it provides a barrier capable of trapping large/stringy foreign particles before they reach the resilient layers of cartridge 20 and cause premature failure of the muffler.

Insert 31A or liner 31 helps reduce the turbulent state of the compressed air before it reaches the resilient layers of the cartridge.

It should be known that insert 31A may be a separate component inserted into cartridge 20 in a replaceable manner to form cartridge assembly 20B. As shown in FIGS. 11–14, liner 31 may comprise an integral part of cartridge assembly 20A and still form a part of this invention.

This inner part of cartridge 20 forming liner 31 or insert 31A may be formed of the same size or larger or smaller wire mesh as that forming a part of cartridge 20. Further, the wire mesh size and the wire gauge may be the same or differ and still fall within the modifications intended to be covered by this invention.

The cylindrical liner 31 or replaceable insert 31A reinforce cartridge 20 and prevents it from collapsing when subjected to negative air pressures.

Figure 6:
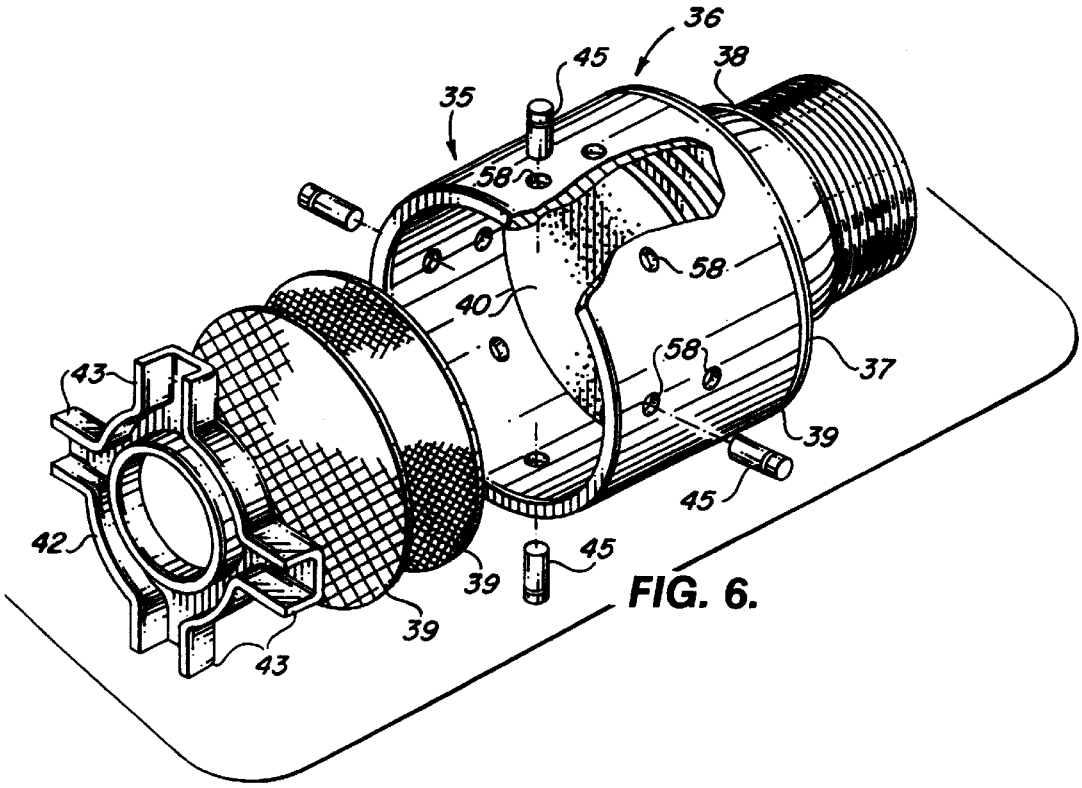
FIG. 6 is an exploded perspective view of a modification of the muffler or silencer shown in FIG. 1.

FIG. 6 discloses a modification of the mufflers shown in FIGS. 1–5 wherein muffler 35 comprises a hollow cylindrical housing 36 connected at end 37 thereof to a coupling 38 in a manner similar to the connection of housing 36 of muffler 15 to coupling 17. Housing 16 which also may be connected to the coupling in the same manner as shown in FIG. 2 is provided with several layers of wire mesh disks 39 comprising different sizes of wire mesh and wire diameter or combinations thereof followed by a plurality of alternate wire mesh disks 39 of similar or different mesh sizes and resilient foam disk 40 of equal or different thickness which are juxtapositioned in housing 36 as shown, laterally of its longitudinal axis. The disks are arranged in a stack configuration with the thickness variable depending on the number of disks used. The left most disk 39 of the stack at the downstream end thereof may be of smaller or larger mesh size or made of perforated metallic disk to retain the cartridge stack.

The stack of disks are held in place in a partially compressed arrangement by an end plate 42. This end plate comprises a star or cross shape configuration, the legs 43 of which are bent to form trough shaped configurations facing outwardly of the muffler configuration or by a flat perforated disk of varying hole sizes. Pins 45 are inserted in apertures 58 in one or the other of the spaced peripheral arrangements, shown in FIG. 6, to extend one in each of the trough shaped legs 43 of end plate 42 to selectively position and hold the end plate in more than one position along the length of muffler 35.

The axial flow air silencer or muffler shown in FIG. 6 provides means for controlling the degree of compression of the cartridge assembly in order to vary the noise reduction performance characteristics of the silencer.

Figure 7:
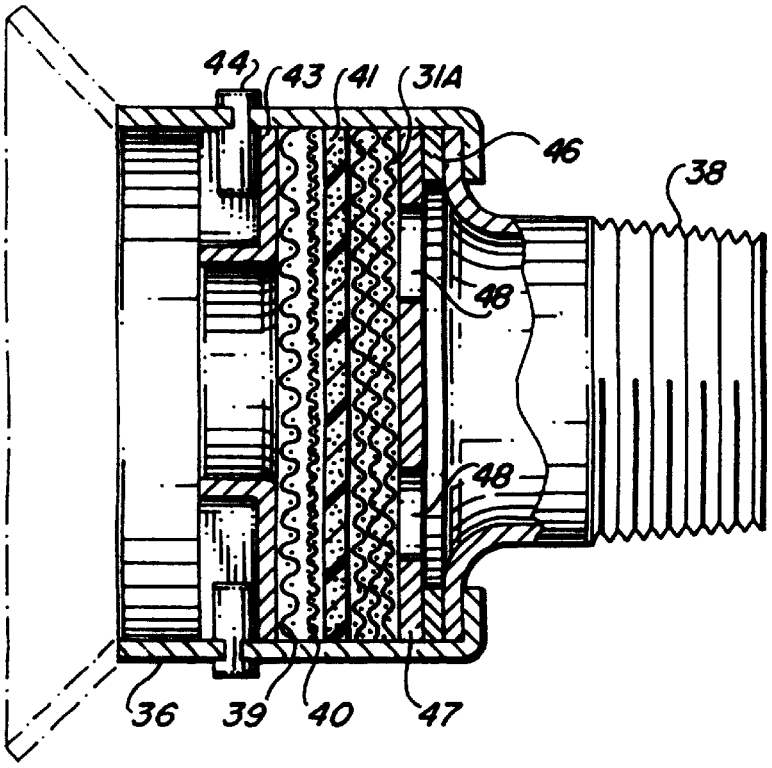
FIG. 7 is a cross sectional view of FIG. 6 when compressed to its assembled form.

FIG. 7 illustrates the structure shown in FIG. 6 in its compressed form wherein the upstream washer 46 adjacent coupling 38 is a soft metal washer. Plate 47 is provided with apertures 48 of different sizes. The perforated plate 47 is intended to break up the blasts or stream of air under pressure received by coupling 38 so as to protect the cartridge stack from premature breakdown. As shown in FIG. 7, pins 44 may be grooved to interlock more effectively with the shell of housing 36 as shown.

FIG. 7 also represents the structure of a muffler for hot gas exhaust applications wherein the disks of the cartridge are made up solely of stacked wire mesh disks of random mesh and wire gauge size without the adjustable feature shown. In this design, the soft metal washer 39 is omitted.

Figure 8:
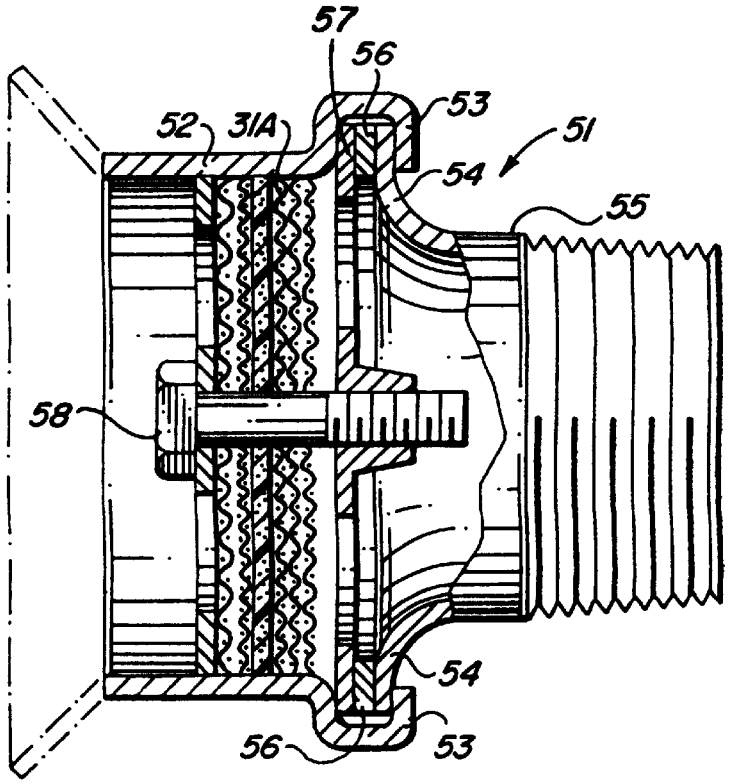
FIG. 8 is a cross sectional view of the muffler or silencer shown in FIGS. 1 and 6.

FIG. 8 discloses a further modification of the muffler shown in FIGS. 6 and 7 wherein the axial flow muffler 51 comprises a housing 52 having a turned in end 53 which captures the flange 54 of the externally threaded coupling 55, gasket 56 and the flange of end plate 57. An infinite step adjustment may be obtained by bolt 58 to control the stack compression of the porous material, the gas discharge rate and thereby the noise level.

When a silencer has been in operation for a length of tiem, foreign particles will have been deposited in the cartridge layers thereby reducing the air discharge rate and the noise level, but increasing air back pressure in the silencer. To correct this condition, the compression of the stack is reduced by bolt 58 shown in FIG. 8 thus restoring the original performance characteristics of the silencer without removing it from the line for repairs or replacement for long periods of time.

It should be noted that the structures shown in the drawings may be used for hot gas discharge devices such as internal combustion engines by merely removing the resilient porous material from the cartridges and employ cylinders or layers of disks of different mesh sizes.

In summary, the invention is intended to improve the air flow characteristics of the silencer; improve the noise muffling performance of the silencer; improve assembly of the silencer; and improve appreciably the life expectancy of the silencer.

To accomplish the above-mentioned improvements, two components have been added to the known silencer. One, is a tubular shaped component called insert 31A which is slidingly inserted inside cartridge 20 to form the core of the cartridge assembly 20B. The other core component, called liner 31, is wound on a mandrel using the same or larger screen mesh and wire diameter or combination thereof, before winding the alternate resilient layers of cartridge 20 to form cartridge assembly 20 and become an integral part of it.

Figure 10:
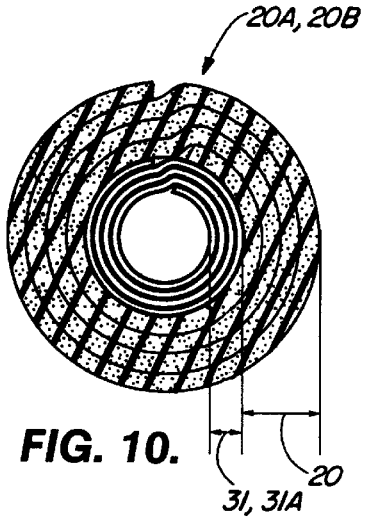
FIG. 10 is a left end view of the cartridge shown in FIG. 9.
Figure 11:
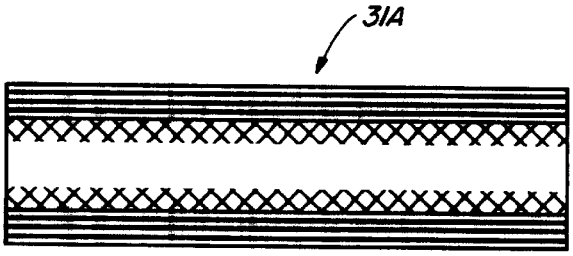
FIG. 11 is a cross sectional view of the cartridge and liner as shown in FIG. 9.
Figure 12:
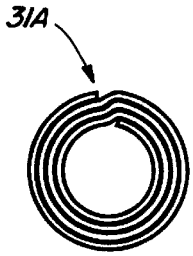
FIG. 12 is a left end view of FIG. 11.
Figure 13:
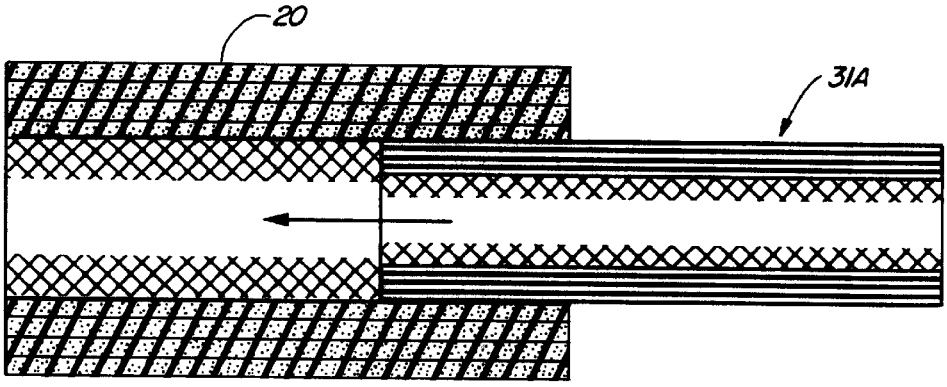
FIG. 13 is a view showing the insert partially within the cartridge.

Referring now to FIGS. 9–10, each cartridge assembly 20A or 20B comprises several alternate layers of soft resilient material and wire screen in addition to the core element.

The core of cartridge assembly 20B can also be made of fibrous, perforated, corrugated, porous, or woven material or any other suitable material which acts as a barrier to the passage of foreign particles, yet allows air or gas to flow freely with a minimal pressure drop.

The cartridge 20 comprises alternate layers of screen and foam and is formed by winding a length of screen together with a length of foam. The straight lines in FIG. 9 represent the screen—the foam is sandwiched between successive turns of screen. The haphazard line segments represent the foam layers.

The liner and the insert are the same except that the insert is removable and replaceable when it becomes contaminated. In the case of the liner, the screen of the cartridge 20 may be continuous with the screen of the insert or may be of different wire diameter and mesh size. The insert has to be a separate part.

Although but a few embodiments of the present invention have been illustrated and described, it will be apparent to those skilled in the art that various changes and modifications may be made therein without departing from the spirit of the invention or from the scope of the appended claims.

What is claimed is:

1. An air exhaust silencer comprising:

a hollow cylindrical housing having an air inlet means at one end of said housing for attachment to an air exhaust and at least one exhaust port, a detachably mounted cylindrical shaped cartridge axially arranged within said housing, said cartridge comprising a plurality of contiguous layers of wire mesh and resilient porous material arranged sequentially in the path of movement of all of the air flow under pressure through the silencer, and a cylindrical shaped insert for fitting into and axially aligned within said cartridge, a cylindrical shaped liner built in as an integral part of the cartridge assembly and axially aligned within said cartridge, said insert and liner comprising a cylinder or wire mesh, the mesh size being the same or larger than the wire mesh of said cartridge, said insert and liner comprising a plurality of contiguous layers of wire mesh, said layers of resilient porous material of said cartridge being confined between adjacent layers of wire mesh deflecting under pressure surges of the air passing therethrough to substantially prevent premature loading of the porous material and excessive flexing and disintegration thereof.

2. The air exhaust silencer set forth in claim 1 wherein the plurality of contiguous layers of wire mesh are arranged sequentially in the path of movement of air flow through said housing.

3. The air exhaust silencer set forth in claim 1 wherein:

said housing comprises a cylindrical configuration, and said cartridge comprises a roll of layered material comprising alternate layers of wire mesh and resilient foam like material.

4. The air exhaust silencer set forth in claim 1 wherein:

said housing comprises a cylinder open at one end and closed at its other end, a resilient gasket positioned within said housing adjacent its closed end, and means for holding said cartridge within said housing under a biased condition against said gasket.

5. The air exhaust silencer set forth in claim 4 wherein:

said means comprises a coupling for closing said one end of said housing, and pin means for extending through said one end of said housing and into said coupling for holding said cartridge in said housing, said coupling providing means for connecting to an air exhaust.

6. The air exhaust silencer set forth in claim 1 wherein:

said layers of resilient porous material are partially compressed laterally of the longitudinal axis of said cartridge between the adjacent layers of said wire mesh.

7. The air exhaust silencer set forth in claim 1 wherein:

each of said layers of resilient porous material of said cartridge is confined between two of said layers of wire mesh resulting in different flow characteristics through said cartridge assembly causing expansion and contraction effects of the confined resilient porous material for effectively absorbing the energy in the air exhaust, said layers of wire mesh and resilient porous material being capable of absorbing air exhaust noise of different frequencies.

8. The air exhaust silencer set forth in claim 1 wherein:

said exhaust port comprises a plurality of windows extending along the length of said housing.

9. The air exhaust silencer set forth in claim 1 wherein:

said air inlet means comprises a coupling having a thickness substantially greater than the thickness of said housing for absorbing the vibrations of the air exhaust, said coupling comprises a groove extending around its periphery, said housing is detachably connected to said groove.

10. A fluid exhaust silencer comprising:

a hollow cylindrical housing having a fluid inlet means at one end of said housing for attachment to a fluid exhaust and at least one exhaust port, a detachably mounted cylindrical shaped cartridge axially arranged within said housing, said cartridge comprising a plurality of contiguous layers of wire mesh and resilient porous material arranged sequentially in the path of movement of all of the fluid flow under pressure through the silencer, and a cylindrical shaped insert for fitting into and axially aligned within said cartridge, a cylindrical shaped liner built in as an integral part of the cartridge assembly and axially aligned within said cartridge, said insert and liner comprising a cylinder or wire mesh, the mesh size being the same or larger than the wire mesh of said cartridge, said insert and liner comprising a plurality of contiguous layers of wire mesh arranged sequentially in the path of movement of fluid flow through said housing, said layers of resilient porous material of said cartridge being confined between adjacent layers of wire mesh deflecting under pressure surges of the fluid passing therethrough to substantially prevent premature loading of the porous material and excessive flexing and disintegration thereof.

* * * * *